United States Patent [19]

Assaf

[11] Patent Number: 4,745,963

[45] Date of Patent: May 24, 1988

[54] HEAT EXCHANGER AND SYSTEMS AND METHODS FOR USING THE SAME

[75] Inventor: Gad Assaf, Rehovot, Israel

[73] Assignee: Geophysical Engineering Company, Seattle, Wash.

[21] Appl. No.: 798,841

[22] Filed: Nov. 18, 1985

Related U.S. Application Data

[62] Division of Ser. No. 558,436, Dec. 6, 1983, Pat. No. 4,583,370.

[51] Int. Cl.[4] ..... F25B 17/00

[52] U.S. Cl. ..... 165/1; 165/104.14; 165/48.1; 165/60; 165/905; 62/271; 47/17

[58] Field of Search ..... 165/104.21, 104.14, 165/60, 1, 48.1; 62/271; 47/17

[56] References Cited

U.S. PATENT DOCUMENTS

| | | | |
|---|---|---|---|
| 837,499 | 12/1906 | Perkins et al. | 165/104.21 |
| 4,259,849 | 4/1981 | Griffiths | 62/271 |
| 4,313,420 | 2/1982 | Poeschl | 47/17 |
| 4,355,683 | 10/1982 | Griffiths | 165/60 |

*Primary Examiner*—Albert W. Davis, Jr.
*Attorney, Agent, or Firm*—Sandler & Greenblum

[57] ABSTRACT

A heat exchanger comprises a housing containing upper and lower layers of fluid, the upper layer being less dense than the lower layer. The large and sharp density gradient at the interface between the upper and lower layers acts to prevent mixing of the two layers. A plurality of vertically oriented tubular sleeves that are closed at each end and filled with fresh water are located in the housing such that the axial ends of each tubular sleeve are in different ones of the layers. Heat added to the liquid in the lower layer is transferred to the liquid in the upper layer through the medium of the water contained in the tubular sleeves.

18 Claims, 2 Drawing Sheets

HEAT EXCHANGER AND SYSTEMS AND METHODS FOR USING THE SAME

This is a division of application Ser. No. 558,436, now U.S. Pat. No. 4,583,370 filed Dec. 6, 1983.

TECHNICAL FIELD

This invention relates to an improved heat exchanger, and to systems and methods for using the same for heat storage, conditioning air, generating power, etc.

BACKGROUND OF THE INVENTION

A system for conditioning air in an enclosure by directly contacting the air therein with a brine shower is disclosed in U.S. Pat. No. 4,355,683. In such system, air in an enclosure is contacted with a brine shower causing water vapor in the air to condense on the brine droplets thereby drying the air. The diluted brine so produced is reconstituted by first heating the diluted brine, and then spraying the heated diluted brine in a tower exposed to the atmosphere where the water extracted from the enclosure is evaporated into the atmosphere. The thus reconstituted brine is then returned to the brine shower associated with the enclosure, and the cycle repeats.

Condensation of water vapor on the brine droplets transfers to the droplets the heat of condensation of water thus increasing the sensible heat of the brine droplets. Normally, this heat is not recovered, particularly when a system as in the '683 patent is used.

In co-pending patent application Ser. No. 377,368 filed May 12, 1982 and Ser. No. 479,009 filed Mar. 23, 1983, a system is disclosed for storing this latent heat of condensation during one period of time (e.g., during the day when the enclosure is a greenhouse, and the water vapor is derived from the expiration of growing plants), and then releasing the stored heat to the enclosure during another period of time (e.g., during the night when the greenhouse is cool). This arrangement has the advantage of being very energy efficient.

In order for the system to operate properly and efficiently, the vapor pressure of the brine entering the shower must be less than the vapor pressure of the air in the greenhouse, this being the property of the brine that renders it hygroscopic and capable of efficiently drying the air in the enclosure. The vapor pressure of the brine is dependent on its temperature and concentration; two parameters that in large measure are established by the volume of brine in a reservoir that feeds the shower. Generally, a volume of about 0.4 $m^3$ of brine, with a concentration of about 30% (calcium chloride or magnesium chloride), per square meter of greenhouse will be required in order to meet the above criterion. At today's prices, the cost of the brine alone will be about \$40.00 per $m^2$ of greenhouse. Compared with the cost of about \$10.00 per $m^2$ for constructing a greenhouse of plastic sheeting, it is clear that the cost of the brine is a dominant factor in the economics of greenhouse utilization. Reducing the amount of brine for cost purposes also reduces the expense of storage and transportation of the brine, and is advantageous in many instances. But, a reduction in the amount of brine will result in a significant increase in the temperature of the brine when it is contacted with the air in the enclosure. As the temperature of the brine increases so does its vapor pressure thus reducing the efficiency of the brine shower in drying the air in the enclosure. As a consequence, the conventional approach has involved providing a brine reservoir of sufficient volume that the heat added to the brine by the condensation of water vapor on the brine droplets in the shower does not significantly raise the temperature of the brine.

It is therefore an object of the present invention to provide a new and improved heat exchanger for removing the heat of condensation from brine.

BRIEF DESCRIPTION OF THE INVENTION

A heat exchanger according to the present invention for cooling heavy fluid, such as concentrated brine, comprises a chamber containing the heavy fluid in the bottom thereof, and containing a lighter fluid on the top of the heavy fluid. Stratification means at the interface between the layers prevents mixing of the two layers; and heat transfer means are provided for enhancing the transfer of heat between the layers independently of the stratification means. While a physical barrier may be interposed between the layers to prevent mixing, the large and steep density gradient at the interface between the layers is effective to suppress mechanical mixing of the two layers. In the preferred construction, the heat transfer means comprises a plurality of elongated, vertically oriented closed cylinders, one end of each of which extends into one layer and the other end into the other layer. Preferably such cylinders are tubular sleeves filled with fluid, preferably water that is fresher than the brine in the lower layer of the housing.

Some heat will be transferred by conduction across the density gradient interface between the upper and lower layers in the housing; but the heat flux is enchanced by reason of the water filled sleeves. The warm brine in the lower layer heats the water contained in the sleeves thereby establishing a natural convection system in each sleeve whereby warmed fresh water in the lower portion of a sleeve flows upwardly into the upper portion of the sleeve where the heat is transferred to the cooler water contained in the upper layer.

When a heat exchanger in accordance with the present invention is utilized as part of a system for conditioning the air in an enclosure such as a greenhouse where a brine shower is used for dehumidifying the greenhouse during day, brine for the brine shower is furnished by the brine contained in the lower layer of the reservoir. In such case, brine is drawn from the lower most portion of the lower layer, usually by pump, and supplied to a brine shower contained within the enclosure.

Droplets of brine in the brine shower are contacted by air in the enclosure thereby causing condensation of water vapor in the air on the brine droplets. This results in dilution as well as heating of the brine which is then returned to the upper portion of the lower layer. Usually, the greenhouse will be excessively hot during daylight hours; and the warm air in the greenhouse also heats the brine. This situation obtains during daylight hours whereby both the heat of condensation of the water vapor evaporated in the enclosure, and the sensible heat contributed by the warm air in the greenhouse are transferred to the brine in the shower, and from the brine in the lower layer of the housing to the fresher water of the upper layer through the medium of the elongated sleeves.

At night, when the temperature in the greenhouse decreases, and evapotranspiration of the plants is suspended, the heat input to the lower layer terminates. Heat stored in the upper layer is now available and can be used to reduce the temperature of the water in the upper layer preparatory to its use the next day.

The heat of condensation transferred into the upper layer of the reservoir can be utilized in a heat engine to generate electricity. In this embodiment, water in the upper layer of the reservoir is evaporated in a flash evaporator producing steam that drives a turbogenerator. Steam exhausted from the turbine is condensed in a direct contact brine heat exchanger where the brine is supplied by the lower layer of the reservoir.

BRIEF DESCRIPTION OF THE DRAWINGS

Embodiments of the invention are shown in the accompanying drawings wherein.

DETAILED DESCRIPTION

Figure 1:
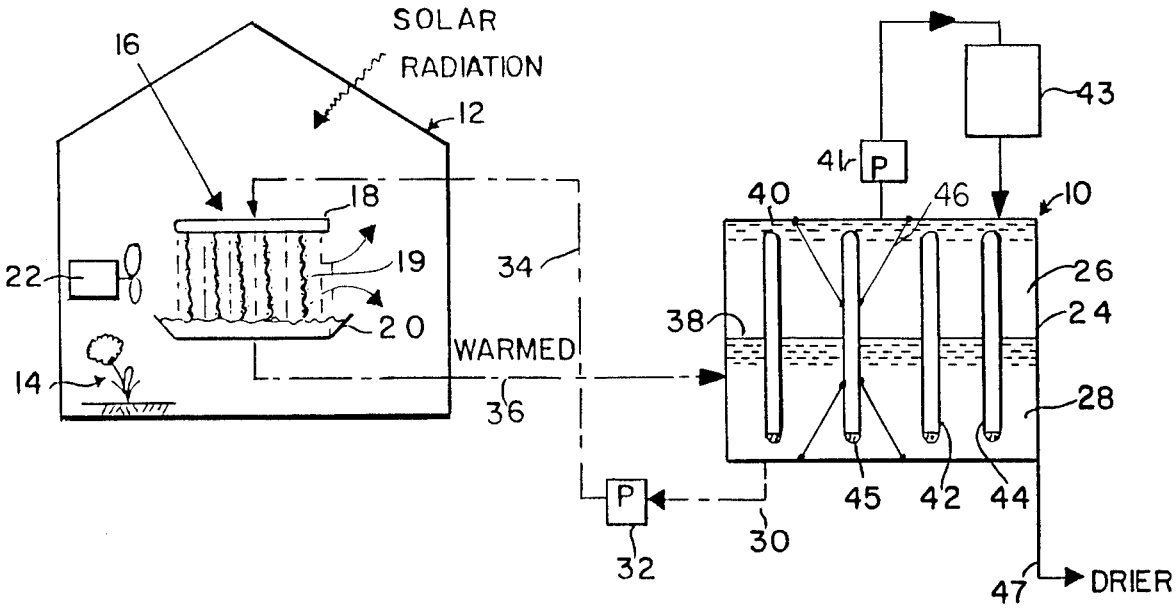
FIG. 1 is a schematic block diagram of a heat exchanger in accordance with the present invention used in combination with an enclosure the air of which is dried during the day.

Referring now to the drawings, reference numeral 10 designates a heat exchanger according to the present invention used for conditioning the air in enclosure 12 which symbolically represents a greenhouse. Enclosure 12 contains growing plants 14, the expiration of which produces water vapor during daylight hours. Solar radiation, during daylight hours, warms the greenhouse and increases the temperature of atmosphere. Environmental conditions in a greenhouse will be enhanced by cooling the greenhouse during the day and removing excess water vapor from the air in the greenhouse. To this end, brine shower 16 is employed. Shower 16 includes header 18 which distributes brine to a plurality of webs 19 of woven material such as jute stretched between headers 18 and reservoir 20 physically located below the header. The header and reservoir are located inside enclosure 12 and are positioned in the path of air blower 22 which produces a flow of air from the enclosure across the woven webs 19 on which a film of brine is present. Brine from the webs drains into reservoir 20.

If the brine is relatively cool, its vapor pressure will be very low compared with the vapor pressure of the water vapor in enclosure 12. As a consequence, the brine will be hygroscopic and water vapor will condense on the surface of the brine film covering webs 19. The condensation of water vapor on the film of brine will release the heat of condensation of water to the brine itself thereby raising the temperature of the brine. During the day, the air temperature in the greenhouse generally will exceed the temperature of the brine which will be heated as a consequence. The somewhat diluted and somewhat heated brine flowing into basin 20 is returned to a brine reservoir.

The system described above is conventional in nature and is well known to those skilled in the art.

According to the present invention, brine for shower 16 furnished by heat exchanger 10 which includes upper fluid layer 26 and lower fluid layer 28. Upper layer 26 is constituted by fresh or brackish water. Lower layer 28 is constituted by the brine used in shower 16. Thus, during daylight operation, brine from the lower portion of lower layer 28 is conducted by pipe 30 to pump 32 which supplies the brine via conduit 34 to header 18 of the brine shower. Warmed brine collected in basin 20 associated with the brine shower is returned via conduit 36 to the upper portion of lower layer 28. With the arrangement just described, the upper portion of lower layer 28 will be warmer than the lower portion of the layer.

The liquid in upper layer 26, being considerably fresher than the brine in lower layer 28 is less dense than the brine. A large and steep density gradient thus exists at interface 38 between the two layers in reservoir 10; and this gradient suppresses mechanical mixing of the two layers. Some heat in the upper portion of the lower layer is transferred across interface 38 into the lower portion of the upper layer by conduction. However, the present invention provides for enhancing the heat flux; and to this end, heat transfer means 40 are employed. Such heat transfer means, according to the present invention, are in the form of a plurality of elongated, vertically oriented cylinders 42. The upper axial ends of the cylinders extend into the upper layer, and the lower axial ends of the cylinder extend into the lower layer. Preferably, the cylinders are tubular sleeves that are closed at each end and filled with fluid 44, preferably, fresh water.

Water contained in the lower portion of the cylinders is heated by the transfer of heat from the brine in layer 28 across the tubular sleeves and its density is reduced. The resultant buoyant water displaces cooler water contained in the upper portion of the sleeves, the cooler and more dense water flowing downwardly to replace the buoyant water. Heat contained in the buoyant water that rises to the upper portion of the sleeves is transferred by conduction across the sleeves into the upper layer thereby heating the water in the upper layer. In this manner, the heat of condensation produced by the condensation of water vapor in enclosure 12 in association with brine shower 16, and sensible heat removed from the air in enclosure 12 is first transferred to the brine in layer 28 and then to the water in layer 26. This process continues during daylight hours; and upper layer 26 accumulates heat during the day in enclosure 12.

At night, when the temperature in the enclosure decreases, the heat stored in upper layer 26 is made available for heating. The heat contained in upper layer 26 can be used for a variety of purposes. For example, it can be used to heat the greenhouse; and the preferable way to accomplish this is to circulate water from the upper layer through a closed heat exchanger in the greenhouse. This expedient has the advantage of heating the air in the greenhouse without increasing its humidity. The disadvantage, however, is the added cost of an indirect heat exchanger. Symbolically, heat removal from the upper layer is indicated in FIG. 1 by pump 41 that circulates water from layer 26 through radiator 43.

The brine in lower layer 28 must be reconstituted periodically to remove the water of condensation absorbed by the brine in shower 16. Many ways exist to achieve this; for example, the brine can be concentrated by spraying it as disclosed in application Ser. No. 367,661 filed Mar. 12, 1982, the disclosure of which is hereby incorporated by reference. Concentration of the brine is shown schematically at 47 as a drier connected to the lower layer.

Cylinders 42, containing water fresher than the brine in layer 28 will be buoyant; and this may require weighting of the bottom of the sleeves so as to counterbalance their buoyancy. This is illustrated by reference numeral 45. Alternatively, or in addition, the water filled tubular sleeves may be stabilized by the use of guys 46 attached to the walls of housing 24.

Preferably, the tubular sleeves are comprised of a thermoplastic polymer such as polyolefin, where the polyolefin is selected from the group consisting essentially of polyethylene and polypropylene. The film from which the tubular sleeves is made should have a thickness of approximately 0.1 mm in order to enhance the transfer of heat across the film. Preferably, the tubes have a length to diameter ratio (L/D) in excess of about 50. Thus, a practical arrangement would involve about 100 sleeves per square meter of cross-section of the housing, the length of the sleeves being about 1 meter.

Figure 2:
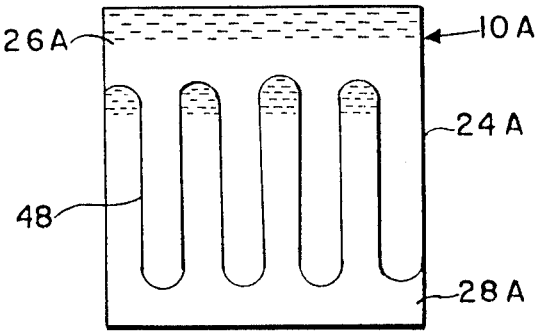
FIG. 2 is another embodiment of the heat exchanger shown in FIG. 1.

Another embodiment of the heat exchanger is illustrated in FIG. 2 wherein a physical barrier is interposed between the upper and lower layers. Referring now to FIG. 2, heat exchanger 10A includes housing 24A containing lower layer 28A of concentrated brine and upper layer 26A of substantially fresh or brackish water of a density much less than the density of the brine in the lower layer. Vertically undulating barrier 48 physically separates the upper from the lower layer. Barrier 48 may be in the form of a thick plastic or metal sheet. The undulating nature of the barrier is such as to greatly increase the area of the interface between the two layers in the heat exchanger, in comparison to the horizontal cross-section of the heat exchanger, and thus enhance the flow of heat between the layers.

Figure 3:
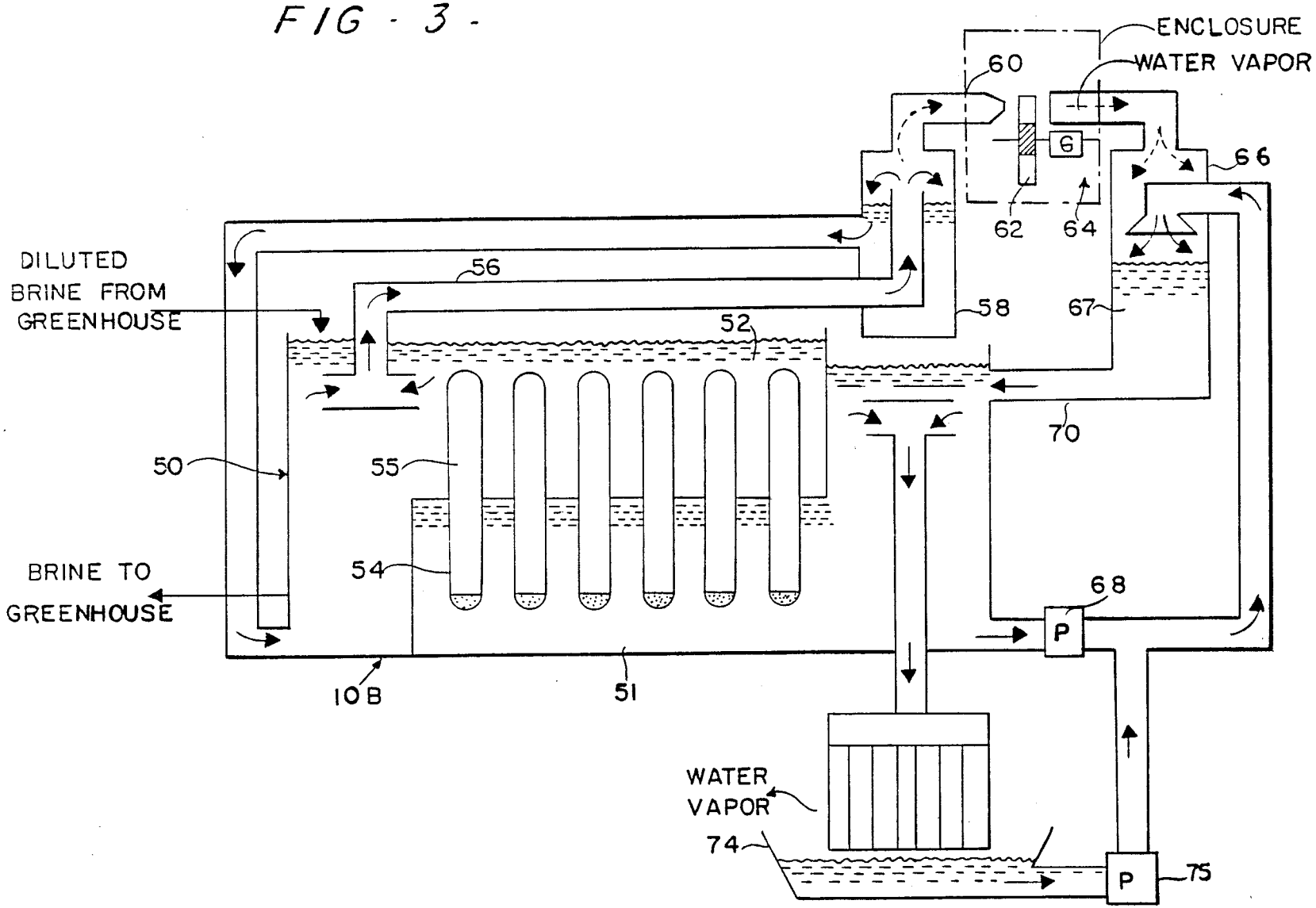
FIG. 3 is a schematic block diagram of a heat exchanger according to the present invention wherein the heat of the upper layer of the reservoir of the heat exchanger is utilized in a heat engine to generate electricity.

Heat contained in the upper layer of the heat exchanger can be extracted therefrom for the purpose of generating electricity in the embodiment shown in FIG. 3 to which reference is now made. In this embodiment, heat exchanger 10B is essentially the same as the heat exchanger 10 shown in FIG. 1. That is to say, the heat exchanger comprises housing 50 containing lower layer 51 of dense brine and upper layer 52 of fresh or brackish water, and a plurality of vertically oriented tubular sleeves 54 that are closed at each axial end and filled with fresh water 55. Warmed water from the upper portion of top layer 52 is transferred by duct 56 to flash evaporator 58 where the water in the liquid is flashed into steam and furnished by conduit 60 to turbine wheel 62 of turbogenerator 64. After expansion in turbine 62, the steam is exhausted into condenser 66 which contains concentrated brine furnished by pump 68 from the lower portion of lower layer 51. Steam exhausted from turbine 62 directly contacts the concentrated brine and condenses on the brine. The resultant liquid 67 is returned to the upper portion of lower layer 51 via conduit 70.

The brine flowing in conduit 70 will be diluted with respect to the brine being furnished to condenser 66 by pump 68 by reason of the water contained in the steam exhausted from turbine 62. The added water must be removed from the brine and this is achieved by brine shower 72 which sprays brine from the upper portion of lower layer 51 into the atmosphere where water vapor is evaporated. The concentrated brine is collected in basin 74 and returned by pump 75 to condenser 66.

Figure 4:
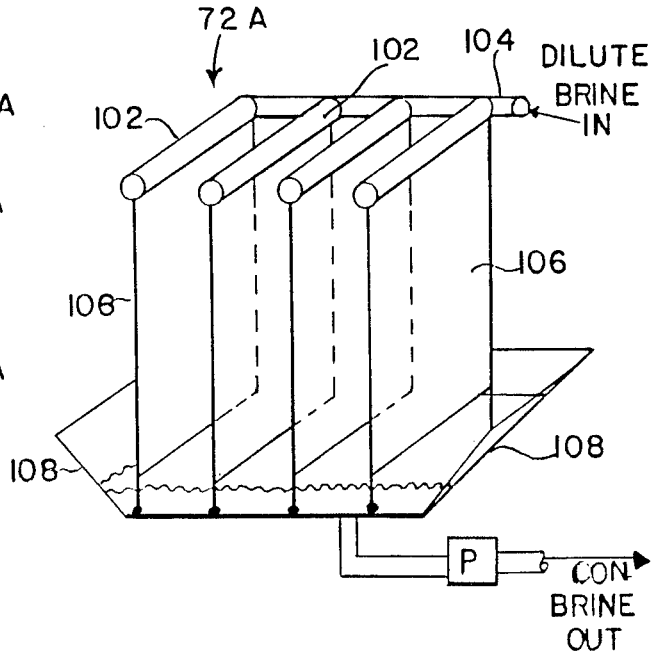
FIG. 4 is another embodiment of a brine shower.

In order to preclude scattering of droplets of brine from the brine shower, and to increase the area of film exposed to air in the enclosure and to the atmosphere during the reconcentration of the brine as shown in FIG. 3, the brine shower may take the configuration shown in FIG. 4. Shower 72A comprises a plurality of pipes 102 fed from a common header 104 supplied with brine. The undersurface of each of the pipes is provided with a plurality of small apertures through which brine exits into woven webs 106 strung between the pipes and reservoir 108. Brine wets the webs and forms a film thereon; and the area of the film can be made arbitrarily large by closely spacing the webs and providing a sufficient number in a direction parallel to the planes of the webs. Finally, the brine film drains from the webs into reservoir 108 from which a pump returns the concentrated brine to condenser 66.

It is believed that the advantages and improved results furnished by the method and apparatus of the present invention are apparent from the foregoing description of the preferred embodiment of the invention. Various changes and modifications may be made without departing from the spirit and scope of the invention as described in the claims that follow.

What is claimed is:

1. A method for conditioning the air of an enclosure such as a greenhouse utilizing a heat exchanger that includes a housing containing upper and lower layers of fluids, the fluid of the lower layer being concentrated brine and the fluid in the upper layer being fresher than the brine in the lower layer, stratification means for preventing mixing of the two layers, and heat transfer means for enhancing transfer of heat between the layers, said method comprising the steps of:

(a) during the day, contacting the air with brine drawn from the lower layer of the heat exchanger for drying the air and heating the contacted brine;

(b) during the day, returning contacted brine to the upper portion of said lower layer of the heat exchanger whereby, during the day, heat absorbed by the contacted brine is transferred to the upper layer of the stratified heat exchanger; and (c) transferring heat from the upper layer of the heat exchanger to the ambient atmosphere.

2. A system for conditioning the air of an enclosure comprising:

(a) a housing containing upper and lower layers of fluid, the fluid of the lower layer being concentrated brine, and the fluid of the upper layer being fresher than the brine in the lower layer;

(b) stratification means for preventing mixing of the two layers;

(c) heat transfer means for enhancing the transfer of heat between the layers;

(d) means for contacting air in said enclosure with a brine-vapor-air direct contact heat exchanger;

(e) means selectively operable during the daytime for conveying brine from said lower layer in said housing to said direct contact heat exchanger; and (f) selectively operable means for cooling fluid from said upper layer in said housing.

3. A system according to claim 2 wherein the heat transfer means for enhancing transfer of heat is constructed and arranged to enhance the transfer of heat between the layers independently of the stratification means.

4. A system according to claim 2 wherein said stratification means includes a barrier for physically separating the layers.

5. A system according to claim 4 wherein said barrier is vertically undulated for increasing the heat transfer area.

6. A system according to claim 5 wherein the heat transfer area exceeds the horizontal cross-sectional area of the interface between the upper and lower layers.

7. A system according to claim 3 wherein the stratification means is constituted by a density gradient at the interface between the two layers.

8. A system according to claim 7 wherein the density gradient is arranged to preclude convection between the layers.

9. A system according to claim 8 wherein said heat transfer means for enhancing transfer of heat comprises a plurality of elongated, vertically oriented cylinders, extending into both layers.

10. A system according to claim 9 wherein the cylinders are tubular sleeves that are closed at each end and are filled with fluid.

11. A system according to claim 10 wherein the fluid in the sleeve is liquid water fresher than the brine in said lower layer.

12. A system according to claim 11 wherein the liquid water is fresh.

13. A system according to claim 12 wherein the position of the tubular sleeves is maintained by weighting the bottom of the tube so as to counterbalance their buoyancy within the concentrated brine of the lower layer.

14. A system according to claim 12 wherein the position of the tubular sleeves is maintained by guys.

15. A system according to claim 10 wherein the sleeves are comprises of a thermoplastic polymer.

16. A system according to claim 13 wherein the thermoplastic polymer is a polyolefin.

17. A system according to claim 14 wherein said polyolefin is selected from the group consisting essentially of polyethylene and polypropylene.

18. A system according to claim 16 wherein the polyolefin comprises a film having a thickness of approximately 0.1 mm, and the cylindrical sleeves have a length to diameter ratio of approximately 50.

* * * * *